US007416311B2

(12) United States Patent
Dietz

(10) Patent No.: US 7,416,311 B2
(45) Date of Patent: Aug. 26, 2008

(54) FLASHLIGHT

(76) Inventor: Dan L. Dietz, 10234 Emerald Dr., Houston, TX (US) 77074

( * ) Notice: Subject to any disclaimer, the term of this patent is extended or adjusted under 35 U.S.C. 154(b) by 0 days.

(21) Appl. No.: 10/908,108

(22) Filed: Apr. 27, 2005

(65) Prior Publication Data

US 2006/0245183 A1 Nov. 2, 2006

(51) Int. Cl.
*F21L 4/00* (2006.01)

(52) U.S. Cl. ..... 362/202; 362/396; 200/60

(58) Field of Classification Search ..... 362/97, 362/396; 200/60; 2/338
See application file for complete search history.

(56) References Cited

U.S. PATENT DOCUMENTS

| | | | | |
|---|---|---|---|---|
| 1,182,965 | A | 5/1916 | Benedict | |
| 1,466,779 | A | 9/1923 | Anakin | |
| 1,824,449 | A | 9/1931 | Sjoberg | |
| 1,838,306 | A | 12/1931 | Graubner | |
| 2,008,070 | A | 7/1935 | Godman | |
| D101,073 | S | 9/1936 | Tamis | |
| 2,277,866 | A | 3/1942 | Le Sage | |
| 2,323,960 | A | 7/1943 | Zeno | |
| 2,386,255 | A | 10/1945 | Morey | |
| 2,484,154 | A | 10/1949 | Devine | |
| D160,757 | S | 10/1950 | Weiss | |
| 2,540,683 | A * | 2/1951 | Maclean | 200/60 |
| 2,550,234 | A | 4/1951 | Duncan | |
| 2,607,883 | A | 8/1952 | Berkowitz | |
| 2,642,519 | A | 6/1953 | Caustin et al. | |
| 2,696,382 | A | 12/1954 | Gelardin | |
| 2,744,189 | A | 5/1956 | Wudyka | |
| D179,114 | S | 11/1956 | Brody | |
| D179,706 | S | 2/1957 | Schwartz | |
| D192,098 | S | 1/1962 | Bautsch | |
| 3,045,111 | A | 7/1962 | Hoenig | |
| 3,303,337 | A | 2/1967 | Lo | |
| 3,604,917 | A | 9/1971 | Schmidt | |
| 3,641,333 | A * | 2/1972 | Gendron | 362/108 |
| 3,737,650 | A | 6/1973 | Kaye et al. | |
| 3,806,724 | A | 4/1974 | Tanner et al. | |
| 3,963,914 | A | 6/1976 | Browning et al. | |
| D260,657 | S | 9/1981 | Funahashi | |
| D292,234 | S | 10/1987 | Schalle | |
| 4,799,132 | A | 1/1989 | Perlsweig | |
| D300,087 | S | 3/1989 | Henderson | |
| D324,235 | S | 2/1992 | Moore | |
| 6,547,414 | B2 | 4/2003 | Steger | |

OTHER PUBLICATIONS

PCT International Search Report for Application No. PCT/US06/15784, dated Aug. 8, 2006.

* cited by examiner

*Primary Examiner*—Sandra O'Shea
*Assistant Examiner*—Anabel Ton

(57) ABSTRACT

A flashlight having a magnet incorporated into the electrical circuit of the flashlight. This flashlight may further include a flexible member which either is provided with a light or conducts light, which flexible member is also provided with a magnet for coupling with the magnet in the circuit.

11 Claims, 3 Drawing Sheets

FLASHLIGHT

BACKGROUND OF THE INVENTION

The present invention relates to flashlights, methods of making and operating flashlights, to methods of lighting, and to methods of positioning flashlights.

A number of patents disclose flashlights and combinations of lights with other objects, the following of which are merely a few.

U.S. Pat. No. 1,182,965, issued on May 16, 1916, to Benedict, discloses a flashlight. The invention pertains more particularly to flashlights adapted to be carried in the upper vest pocket without inconvenience and in the same manner that a fountain pen is carried.

U.S. Pat. No. 1,466,779, issued on Sep. 4, 1923, to Anakin, discloses a combined cigar lighter and flashlight. The invention relates to a cigar lighter attachment for portable flashlights, and has for its object to provide a combined flashlight and cigar lighter in which a single battery furnishes the electric current for the lamp of the flashlight and also for the ignition device of the cigar lighter.

U.S. Pat. No. 1,824,449, issued on Sep. 22, 1931, to Sjoberg, discloses a cane, and more especially a novelty cane for campaign and street parade purposes having in combination the following features, namely, a collapsible cane adapted to be divided into a plurality of sections for convenience in carrying, a cane having an electric light bulb in one end and a source of current in the cane body to light the bulb for purposes of illumination and display, a pennant or flag folded into the body of the cane and adapted to be reversed in position to make the cane a part of its staff, and a whistle incorporated at the end of one of the cane sections.

U.S. Pat. No. 1,838,306, issued on Dec. 29, 1931, to Graubner, discloses a flashlight. This invention relates to flashlights or battery hand lamps, and more particularly to an improved bottom cap therefor carrying a whistle or similar device.

U.S. Pat. No. 2,008,070, issued on Jul. 16, 1935, to Godman, discloses light attachments for pens and pencils. The invention relates to new and useful improvements in light attachments for pens and pencils and has for its primary object to provide a self-contained lamp of the flashlight type which is adapted to be expeditiously mounted on a pen or pencil in a manner to facilitate writing in the dark.

U.S. Design Pat. No. 101,073, issued on Sep. 1, 1936, to Tamis, discloses a combined knife, pencil and watch.

U.S. Pat. No. 2,277,866, issued on Mar. 31, 1942, to Sage, discloses a hand operated electric light signal device. The invention relates to a device for use both as a flash light and as a safety and signal device in driving an automobile at night.

U.S. Pat. No. 2,323,960, issued on Jul. 13, 1943, to Zeno, discloses a combined cigarette lighter, flashlight, and writing implement. This invention relates to new and useful improvements in a combined cigarette lighter, flashlight and writing implement.

U.S. Pat. No. 2,386,255, issued on Oct. 9, 1945, to Morey, discloses a flashlight, and more particularly flashlights which have resilient gripping means arranged to receive a mirror, or the material forming a pocket or other portion of the wearing apparel of the user so that the flashlight may be supported in position for use without being withheld in the hand.

U.S. Pat. No. 2,484,154, issued on Oct. 11, 1949, to Devine, discloses an illuminated fountain pen, having a means for providing illumination during writing.

U.S. Design Pat. No. 160,757, issued on Oct. 31, 1950, to Weiss, discloses a combined pencil, ball pen and flashlight.

U.S. Pat. No. 2,550,234, issued on Apr. 24, 1951, to Duncan, discloses a combination flashlight and circuit tester. The invention relates to the general class of electrical illumination, including portable self contained electric lamps of the battery supported type wherein the cells are arranged in the casing in direct contact with a lamp, and more specifically to a combination flashlight and circuit tester which while adapted for various purposes and uses, is especially designed, in addition to the performance of its functions as a flashlight, is also equipped for testing the circuits of various electric equipments.

U.S. Pat. No. 2,607,883, issued on Aug. 19, 1952, to Berkowitz, discloses a flashlight for use in a combined flashlight, cigarette lighter and writing implement.

U.S. Pat. No. 2,642,519, issued on Jun. 16, 1953, to Caustin et al., discloses a luminiferous cane. This invention relates to luminiferous canes, walking sticks, or the like and more particularly to an improved construction for such devices so as to make them distinguishable in darkness as well as in daylight.

U.S. Pat. No. 2,696,382, issued on Dec. 9, 1954, to Gelardin, discloses a mouth activated flashlight simulating a lit cigar. The present invention relates to a flashlight novelty, and it particularly relates to a flashlight novelty in the form of a cigar holder and simulated cigar therein, which may be actuated by the lips and/or the teeth.

U.S. Pat. No. 2,744,189, issued on May 1, 1956, to Wudyka, discloses a portable lamp. This invention relates to a portable lamp, more specifically to a plastic article containing a dry-cell battery and bulb, and lighted by turning its head.

U.S. Design Pat. No. 179,114, issued on Nov. 6, 1956, to Brody, discloses a combined flashlight and key chain.

U.S. Design Pat. No. 179,706, issued on Feb. 12, 1957, to Schwartz, discloses a combined pencil and flashlight.

U.S. Design Pat. No. 192,098, issued on Jan. 16, 1962, to Bautsch, discloses a combined flashlight, whistle, compass and key chain holder.

U.S. Pat. No. 3,045,111, issued on Jul. 17, 1962, to Hoenig, discloses a ballpoint pen light. This invention relates to a pen construction and particularly to a ballpoint pen construction, having self-contained electrical illuminating means, and means whereby, when the tip of the ballpoint pen is extended into writing position, beams of light are directed onto a writing surface and concentrated in an area around the tip of the pen onto the writing surface so that the user may write with this pen in the dark without disturbing persons who may be in an area adjacent to the user of the pen.

U.S. Pat. No. 3,303,337, issued on Feb. 7, 1967, to Kan Cheung Lo, discloses illuminated writing instruments that are a combination electric hand torch and writing instrument.

U.S. Pat. No. 3,604,917, issued on Sep. 14, 1971, to Schmidt, discloses a ballpoint pen light. The ballpoint pen construction has a self-contained electrical illuminating source and structural couplings whereby the ballpoint cartridge may be extended for use either with or without utilization of the illumination means, thereby conserving the energy in the power source when the pen is in operation and the illumination is unnecessary.

U.S. Pat. No. 3,737,650, issued on Jun. 5, 1973, to Kaye et al., discloses a disposable flashlight. This invention related to a disposable flashlight, with dimensions comparable to those of an ordinary pencil or thin pen, and provided with a clip which serves the double purpose of supporting the flashlight on a pocket flap, and of serving as a manually operable switch for closing the circuit to the flashlight from an enclosed battery cell, to cause the light to be energized and to function as a light source, for selected intermittent operation, or for fixed continuous operation.

U.S. Pat. No. 3,806,724, issued on Apr. 23, 1974, to Tanner et al., discloses a disposable composite conductor tube for flashlight constructions. A conductor tube construction suitable for use in disposable flashlights, or the like, which, because of its simplicity is both extremely economical to produce and is therefore feasibly disposable.

U.S. Pat. No. 3,963,914, issued on Jun. 15, 1976, to Browning et al., discloses a combination writing implement and flashlight, wherein the device is interiorly illuminated, and ultimately conducts such illumination in either of two directions, depending upon on which end the cap of the implement is placed. The cap includes reflective means for reversing light-flow back through the light-conductive or translucent barrel, toward the end piece and to the writing tip itself, concentrically thereabout. Optionally, the cap is disposed on the reverse end, in which event the light is actuated to send illumination in the opposite direction, the device thereby serving as a flashlight. Aperture means may be provided to the cap so that the usually provided clip can be depressed to actuate the pressure switch of the implement. The cap can be made of a resilient deformable plastic material so that by squeezing the same the pressure switch means of the implement may be actuated.

U.S. Design Pat. No. 260,657, issued on Sep. 8, 1981, to Funahashi, discloses an ornamental design for a felt pen.

U.S. Design Pat. No. 292,234, issued on Oct. 13, 1987, to O'Grady, discloses a combined beer light and key holder.

U.S. Pat. No. 4,799,132, issued on Jan. 17, 1989, to Perlsweig, discloses a means for mounting a mini-flashlight on a writing instrument. A clip arrangement for mounting a miniature flashlight on a writing instrument has a pair of spring clips pivotally coupled to the respective ends of an elongated support member and rotatable in a common plane with said member. The clips are shaped and dimensioned to releasably frictionally engage a writing instrument and flashlight, respectively, and are formed to extend from their pivotal couplings in a direction substantially perpendicular to the longitudinal dimensions of the writing instrument and flashlight. The configuration provides improved adjustability of the light relative to the writing instrument and allows ready attachment to and removal from a substantial range of diameters of writing instruments and flashlights.

U.S. Design Pat. No. 300,087, issued on Mar. 7, 1989, to Henderson, discloses an ornamental design for a combination key holder, pen and flashlight.

U.S. Design Pat. No. 324,235, issued on Feb. 25, 1992, to Moore, discloses an ornamental design for a combined pen and flashlight.

SUMMARY OF THE INVENTION

According to one embodiment of the present invention, there is provided a flashlight having a body defining a battery compartment for holding a battery, a switch, a light, and a magnet supported by the body and comprising a conductor. When a battery is positioned in the battery compartment, an electrical circuit is defined between the battery, the switch, the light and the conductor.

According to another embodiment of the present invention, there is provided a flashlight having a body defining a battery compartment for holding a battery, a switch, a light, and a magnet positioned within the body. When a battery is positioned in the battery compartment, an electrical circuit is defined between the battery, the switch, and the light.

According to even another embodiment of the present invention, there is provided a flashlight having a body defining a battery compartment for holding a battery, a switch, a flexible member supporting a light and supporting a first magnetic coupling member, and a second magnetic coupling member supported by the body and comprising a conductor. When a battery is positioned in the battery compartment, an electrical circuit is defined between the battery, the switch, the light and the conductor. At least one of the first magnetic coupling member and the second magnetic coupling member are magnetic and the other is either magnetic or ferrous.

According to still another embodiment of the present invention, there is provided a flashlight having a body defining a battery compartment for holding a battery, a switch, a flexible member supporting a light and supporting a first magnetic coupling member, and a second magnetic coupling member positioned within the body. When a battery is positioned in the battery compartment, an electrical circuit is defined between the battery, the switch, and the light. At least one of the first magnetic coupling member and the second magnetic coupling member are magnetic and the other is either magnetic or ferrous.

According to yet another embodiment of the present invention, there is provided a flashlight having a body defining a battery compartment for holding a battery, a switch, a flexible light conducting member supporting a first magnetic coupling member, a light positioned to provide light to the flexible light conducting member, and a second magnetic coupling member supported by the body and comprising a conductor. When a battery is positioned in the battery compartment, an electrical circuit is defined between the battery, the switch, the light and the conductor. At least one of the first magnetic coupling member and the second magnetic coupling member are magnetic and the other is either magnetic or ferrous.

According to even still another embodiment of the present invention, there is provided a flashlight having a body defining a battery compartment for holding a battery, a switch, a flexible light conducting member supporting a first magnetic coupling member, a light positioned to provide light to the flexible light conducting member, and a second magnetic coupling member positioned within the body. When a battery is positioned in the battery compartment, an electrical circuit is defined between the battery, the switch, and the light. At least one of the first magnetic coupling member and the second magnetic coupling member are magnetic and the other is either magnetic or ferrous.

According to still further embodiments of the present invention, there are provided methods of making the above flashlights, methods of using the above flashlights, methods of illuminating using the above flashlights, methods of anchoring or coupling the above flashlights to other objects.

DETAILED DESCRIPTION OF THE INVENTION

The flashlight of the present invention includes a housing defining a battery compartment for holding one or more batteries as desired. The flashlight further includes a light, switch and a magnet. The magnet may be positioned anywhere in or on the flashlight, but is preferably positioned within the housing, and may or may not be electrically conductive. With the required one or more batteries positioned in the battery compartment, an electrical circuit is formed between the battery (ies), light, and switch, and in one embodiment the magnet is also part of the circuit.

In another embodiment of the flashlight of the present invention, a flexible member is provided which may have a light positioned in the end thereof, or the flexible member may conduct light there through. The flexible member may optionally be provided with a second magnetically coupling member to magnetically couple with a first magnetically coupling member positioned in the battery housing.

A coupling method includes magnetically coupling the flashlight of the present invention with another item to form a magnetically coupled item.

In a preferred embodiment, a combination writing instrument and flashlight may be obtained by magnetically coupling the flashlight of the present invention with a writing instrument. While it may be coupled with any writing instrument, it is preferably coupled with the writing instruments disclosed in U.S. patent application Ser. No. 10/907,734, filed Apr. 13, 2005, by the present inventor, the disclosure of which is hereby incorporated by reference for all that it discloses, suggests and teaches. In such a magnetic coupling, at least one of the flashlight or writing instrument comprises a magnet, with the other comprising a magnet or a magnetically coupling material such as a ferrous metal.

In another preferred embodiment, the flashlight of the present invention may be magnetically coupled with a utility clip, preferably the utility clip as disclosed in U.S. patent application Ser. No. 10/907,919, filed Apr. 21, 2005 by the present inventor, the disclosure of which is hereby incorporated by reference for all that it discloses, suggests and teaches. In such a magnetic coupling, at least one of the flashlight or clip comprises a magnet, with the other comprising a magnet or a magnetically coupling material such as a ferrous metal.

In the case of the embodiment with the flexible member, the magnetic coupling of the first and second magnetically coupling members may be utilized to position the flexible member and thus the direction of the light. Additionally, the flashlight may be anchored to a thin object, a shirt pocket for example, by placing the flashlight in the pocket and engaging the shirt pocket between the first and second magnetically coupling members.

The present invention will now be described by reference to the drawings.

Figure 1:
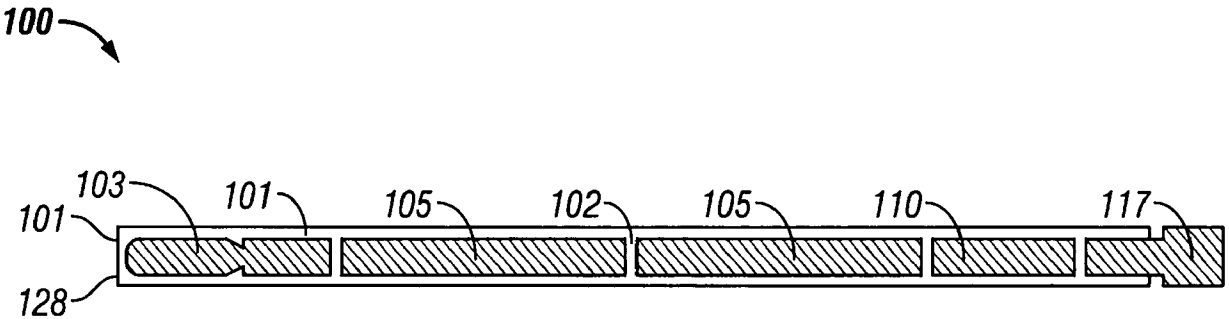
FIG. 1 is an illustration showing flashlight 100 having a housing 101 defining battery compartment 102, and supporting light 103, switch 117, and magnet 110.

Referring first to FIG. 1, there is shown flashlight 100 having a housing 101 defining battery compartment 102. Housing 101 further supports light 103, switch 117, and magnet 110. While magnet 110 may be positioned on the exterior of housing 101, it is preferably positioned within housing 101. Magnet 110 may or may not be conductive. When it is not conductive, it may be necessary to complete the flashlight circuit around the magnet 110. Magnet 110 may be conductive such that when the required number of one or more batteries 105 is positioned in battery compartment 102, an electrical circuit is formed between the batteries 105, switch 117, light 103 and magnet 110. Electrical connectors as are known may be utilized to complete the circuit and electrically connect the batteries 105, switch 117, light 103 and magnet 110. An optional lens 128 may be provided as are known in the art.

It should be understood that battery 105 is a standard battery as is known in the art.

Light 103 may be any light as is known in the art, but is preferably an LED type light.

Figure 2A:
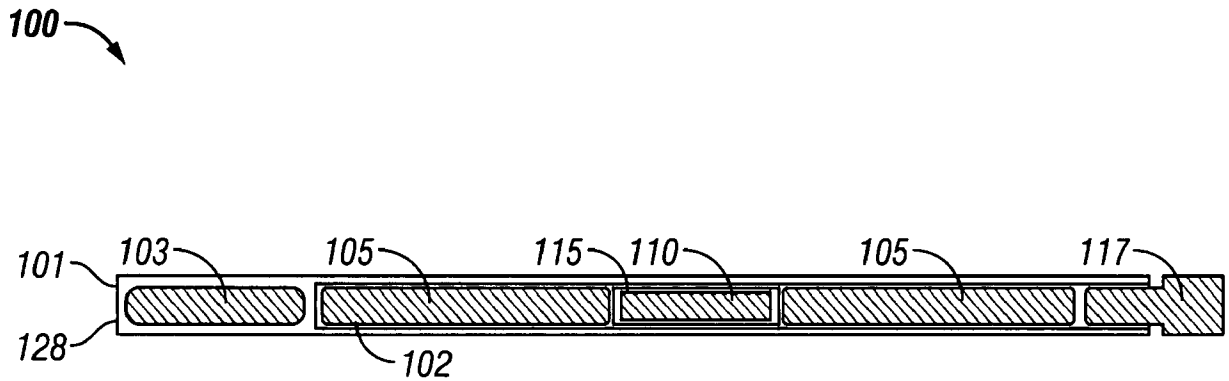
FIGS. 2A, 2B and 2C, show a number of optional embodiments for flashlight 100, with the variable being the type of magnet 110 utilized, showing that magnet 110 may be made conductive by utilizing a conductive coating 115 (FIG. 2A), utilizing a conductive member 111 thru magnet 110 (FIG. 2B), or by utilizing a solid conductive magnet (FIG. 2C).
Figure 2B:
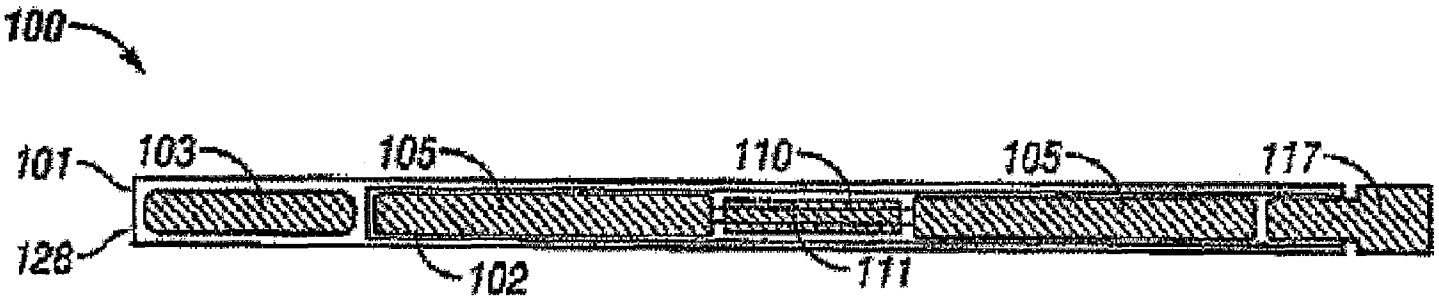
Figure 2C:
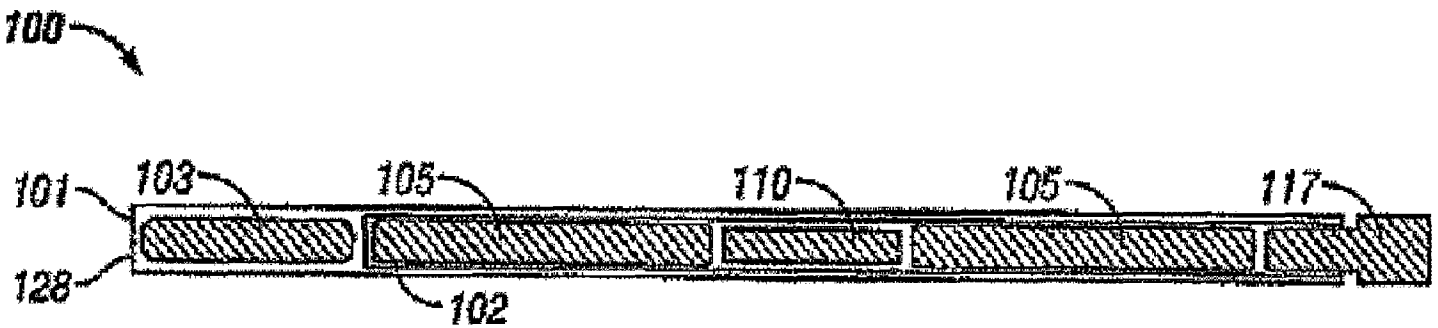

Referring now to FIGS. 2A, 2B and 2C, there is shown a number of optional embodiments for flashlight 100, with the variable being the type of magnet 110 utilized. Magnet 110 may be made conductive by utilizing a conductive coating 115 (FIG. 2A), utilizing a conductive member 111 thru magnet 110 (FIG. 2B), or by utilizing a solid conductive magnet (FIG. 2C). While the magnets 110 of FIGS. 2A, 2B and 2C are shown housed within housing 101 and interposed between batteries 105 and conductive, it should be understood that magnets 110 may be exterior to housing 101, may be positioned anywhere within housing 101, and may or may not be conductive. For stability when coupling flashlight 100 to another object, two or more magnets 110 may be utilized.

As a non-limiting example of a suitable magnet and position, an annularly shaped magnet (i.e., a ring magnet) may be placed in the annular space between battery 105 and housing 101. Such a magnet may or may not be part of the flashlight circuit.

Conductive coating 115 may comprise any suitable electrically conductive material that is compatible with magnet 110 and flashlight 100. Conductive coating 115 may fully encompass magnet 110, or may partially coat magnet 110 in a manner to provide a sufficient electrical pathway to complete the flashlight circuit.

Conductive member 111 may traverse any section of magnet 110, but is most conveniently positioned in the center of magnet 110 to engage the normally centered electrical contacts on batteries 105.

The flashlight 100 will operate as follows. Operating of switch 117 will serve to open or close the flashlight circuit between the batteries 105, switch 117, light 103 and magnet 110 (when included in the circuit), to turn light 103 off or on.

Another embodiment of the flashlight of the present invention, includes substitution of magnet 110 with a non-magnetic magnetically coupling material, for example a ferrous material.

Figure 3:
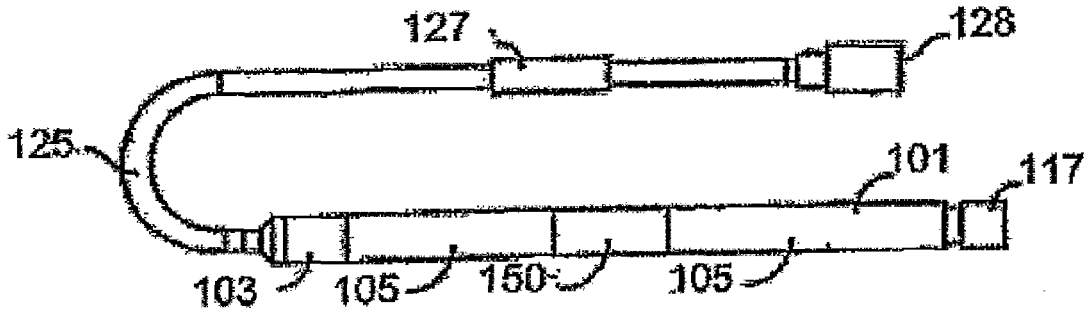
FIG. 3 is an illustration of another flashlight embodiment of the present invention showing flashlight 100 provided with a light conducting flexible member 125 attached to housing 101, such that light from light 103 is directed thru flexible member 125 out thru optional lens 128. A second magnetically coupling member 127 is provided to engage magnetically coupling member 150.

Referring now to FIG. 3, there is shown another flashlight embodiment of the present invention. Flashlight 100 is further provided with a light conducting flexible member 125 attached to housing 101, such that light from light 103 is directed thru flexible member 125 out thru optional lens 128. A second magnetically coupling member 127 is provided to engage magnetically coupling member 150.

Of course, in order to magnetically couple, at least one of second magnetically coupling member 127 and magnetically coupling member 150 must be magnetic and the other may be magnetic or a non-magnetic magnetically coupling material such as a ferrous material. Coupling of second magnetically coupling member 127 and magnetically coupling member 150 may be utilized to position lens 128 to direct light in a desired manner. Additionally, coupling of second magnetically coupling member 127 and magnetically coupling member 150 may be utilized to anchor flashlight 100 to a thin object such as a shirt pocket, by positioning the shirt pocket material between the magnetically engaged magnetically coupling member 150 and second magnetically coupling member 127.

Figure 4:
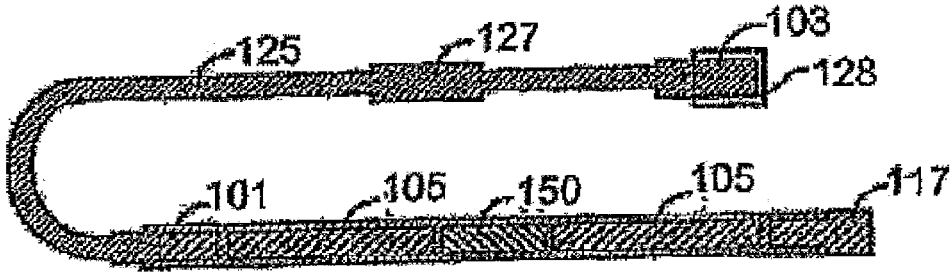
FIG. 4 shows another flashlight embodiment of the present invention with light 103 positioned at the end of flexible member 125.

Referring now to FIG. 4, there is shown another flashlight embodiment of the present invention. This flashlight 100 is provided with a light 103 positioned at the end of flexible member 125. A second magnetically coupling member 127 is provided to engage magnetically coupling member 150.

All written materials cited herein, including patents, patent applications, articles, publications, and books, are hereby incorporated by reference for all that they disclose, suggest and teach.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which this invention pertains.

What is claimed is:

1. A flashlight comprising:

a body defining a battery compartment for holding a battery;

a switch;

a light; and a magnet supported by the body and comprising a conductor, wherein the magnet is disposed between the switch and the light;

wherein when a battery is positioned in the battery compartment, an electrical circuit is defined between the battery, the switch, the light and the conductor, and wherein the conductor comprises a conductive coating.

2. The flashlight of claim 1, wherein the magnet is positioned within the body.

3. The flashlight of claim 1, wherein the magnet is positioned within the battery compartment.

4. A flashlight comprising:

a body defining a battery compartment for holding a battery;

a switch;

a light; and a magnet positioned within the body;

wherein, when a battery is positioned in the battery compartment, an electrical circuit is defined between the battery, the switch, and the light, and wherein the electrical circuit is completed around the magnet, and further wherein the magnet is disposed between the battery and the light.

5. The flashlight of claim 1, wherein the magnet is further disposed between the battery and the switch.

6. A flashlight comprising:

a body defining a battery compartment for holding a battery;

a switch;

a light; and a magnet supported by the body and comprising a conductor, wherein the magnet is disposed between the switch and the light;

wherein when a battery is positioned in the battery compartment, an electrical circuit is defined between the battery, the switch, the light and the conductor, and wherein the magnet is further disposed between the battery and the light.

7. A flashlight comprising:

a body defining a battery compartment for holding a battery;

a switch;

a light; and a magnet supported by the body and comprising a conductor, wherein the magnet is disposed between the switch and the light;

wherein when a battery is positioned in the battery compartment, an electrical circuit is defined between the battery, the switch, the light and the conductor, and wherein the flashlight comprises a second battery, and wherein the magnet is disposed between the battery and the second battery.

8. The flashlight of claim 6, wherein the conductor comprises a conductive member.

9. A method of forming a magnetically coupled item, comprising:

(A) providing the flashlight of claim 1;

(B) providing another item;

(C) magnetically coupling the flashlight to the another item to form the magnetically coupled item.

10. The method of claim 9, wherein the another item is a writing instrument.

11. The method of claim 9, wherein the another item is a utility clip.

* * * * *